United States Patent [19]

Persson et al.

[11] Patent Number: 4,479,533

[45] Date of Patent: Oct. 30, 1984

[54] TERTIARY HEAT EXCHANGER

[76] Inventors: Ingemar Persson, Tallv. 3, Taberg; Olov Eklind, Humlegarden 1, Jonkoping, both of Sweden

[21] Appl. No.: 267,537

[22] Filed: May 27, 1981

[30] Foreign Application Priority Data

May 27, 1980 [SE] Sweden ..... 8003940

[51] Int. Cl.³ ..... F28D 7/04; F28F 9/22; F28F 9/26

[52] U.S. Cl. ..... 165/140; 165/159; 165/160; 165/163; 165/139; 237/19

[58] Field of Search ..... 165/140, 141, 164, 159, 165/160, 163, 139

[56] References Cited

U.S. PATENT DOCUMENTS

| | | | |
|---|---|---|---|
| 1,956,133 | 4/1934 | Rosenblad | 165/139 |
| 1,965,553 | 7/1934 | Lear | 165/140 |
| 2,523,990 | 9/1950 | Graham | 165/163 |
| 2,721,676 | 10/1955 | Rick | 165/139 X |
| 2,736,533 | 2/1956 | Allen | 165/140 |
| 2,817,498 | 12/1957 | Miller | 165/139 X |
| 4,306,618 | 12/1981 | Honbajarui | 165/163 |

FOREIGN PATENT DOCUMENTS

| | | | |
|---|---|---|---|
| 94992 | 3/1963 | Denmark | 165/163 |
| 273142 | 10/1912 | Fed. Rep. of Germany | 165/164 |
| 397812 | 3/1909 | France | 165/164 |
| 486237 | 6/1938 | United Kingdom | 165/140 |
| 667281 | 2/1952 | United Kingdom | 165/140 |

*Primary Examiner*—Albert W. Davis, Jr.
*Attorney, Agent, or Firm*—Holman & Stern

[57] ABSTRACT

A tertiary heat exchanger having three sets of adjacent ducting, two stacked within the third, all of which carrying heat exchange mediums so that the heat carried by one medium in any set of a ducting is efficiently transferred to the other two. Two of the three sets of ducting are tubing and this tubing is spirally coiled in a container within the third set of ducting. The two sets of tubing are in alternating layers and the fluid flow of the heat exchange mediums are in opposite directions in each adjacent layer of the tubing. Outlet channels are provided at various points along the helical path of a ducting so as to alter the effective length of a ducting.

13 Claims, 2 Drawing Figures

TERTIARY HEAT EXCHANGER

BACKGROUND OF THE INVENTION

1. Field of the Invention

The present invention relates to heat exchangers, and more particularly to heat exchangers having first and second spiral tube arrangements conducting first and second heat exchange mediums, respectively, with a third heat exchange medium conducted through a plurality of ducts formed between, and surrounding, the tube spirals.

2. Description of the Prior Art

Many fields of use exist for tertiary heat exchangers: radiator exchangers, hot water exchangers in a heat pump, district heating systems or boiler stations, heat exchangers in water storage tanks, ground heat exchangers, etc.

Typically heating stations with heat pumps and/or district heating constitute an area where tertiary heat exchangers are required. In such stations, there is a flow of heat exchange medium into a first side of the exchanger, which is supplied with heat from a heat pump, a solar absorbator, or the like. A second side of the exchanger includes, on the one hand, a charging circuit of a storage tank for warm water, and on the other hand, a radiator circuit. Previously known heat exchangers of the tertiary type used in this field comprised separate stacks of tube spirals, each one conducting a heat exchange medium and positioned in a tank. Between the two stacks of tube spirals, a third heat exchange medium served as a heat exchanging agent.

A primary purpose of the invention is to provide a heat exchanger in which the effective lengths of flow of the two heat exchange mediums in the primary and secondary circuits can be made different, so that it is possible to optimize the quantity of exchanged heat at certain pressure drops and temperature levels. In practice, this can be attained in such a way that the media are conducted in spiral tubes and ducts from the center of the vessel to the periphery, or between an input position and an output position a bit from the center end the periphery. The effective length of the spiral duct can thereby be more or less shortened independent of the routes of flow of the other fluids, and can be located arbitrarily along the routes of these ones.

SUMMARY OF THE INVENTION

These and other purposes may be realized by the present invention in which a tertiary heat exchanger is provided with three sets of adjacent ducting, two stacked within the third, all of which carrying heat exchange mediums therethrough, so that heat carried by one medium in any set of the ducting is efficiently transferred to the others. The heat exchanger is provided with primary and secondary tubing or ducting which is coiled or wound in a spiral fashion in a cylindrical tank. The primary and secondary tubing is stacked in alternating layers, and pressed together by the tank end walls. Jacketing the primary and secondary stacked layers is the tertiary ducting which permits a third heat exchange medium carried within to be placed in intimate contact with the primary and secondary tubing. In this way, the tertiary heat exchanger of the present invention provides substantially increased efficiency over tertiary heat exchangers heretofore known in the prior art.

BRIEF DESCRIPTION OF THE DRAWINGS

An embodiment of the invention is described as follows, with reference to the accompany drawings, in which.

DETAILED DESCRIPTION OF THE INVENTION

Figure 1:
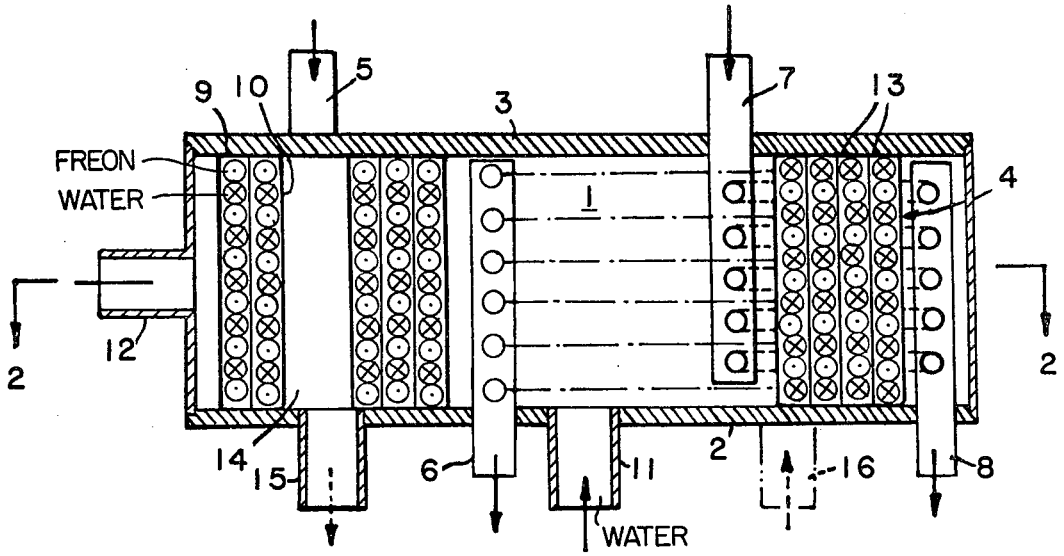
FIG. 1 shows a vertical cross-section through a heat exchanger according to the present invention.
Figure 2:
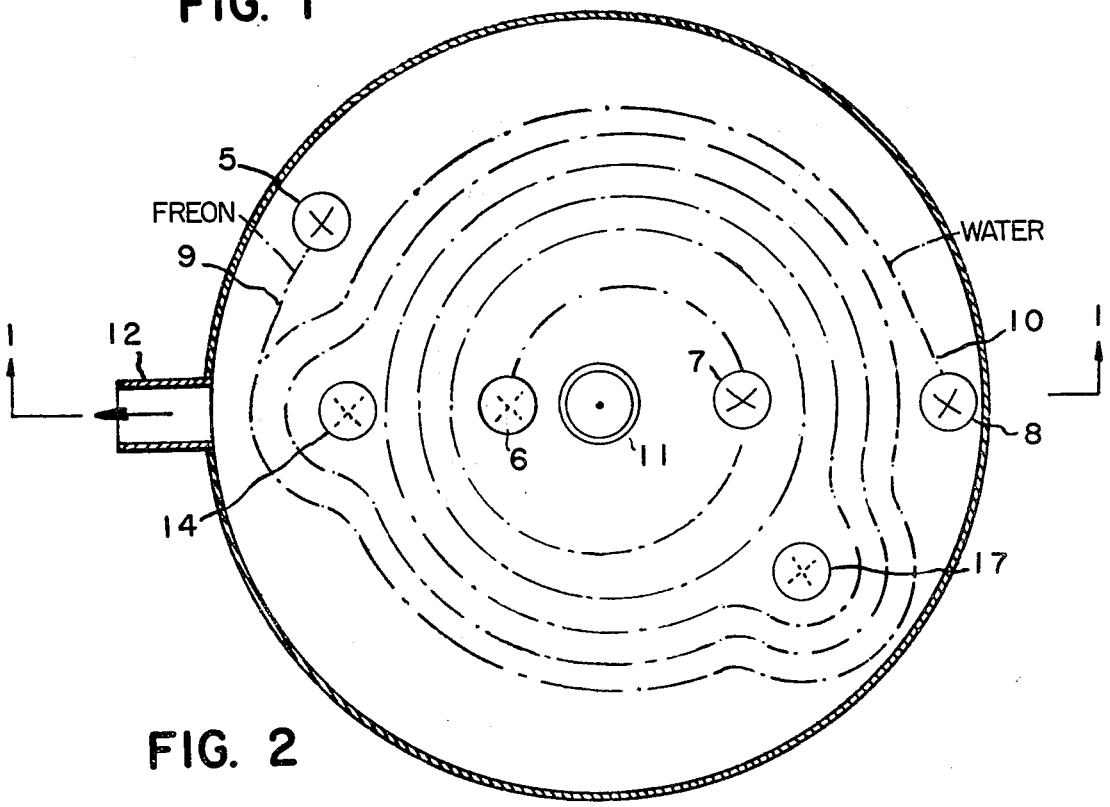
FIG. 2 illustrates the view taken along section line 2-2 of FIG. 1, showing a sectional view of the heat exchanger tank and the corresponding winding pattern for the tube spirals enclosed within the heat exchanger.

Referring now to the drawings wherein like reference numerals represent identical or corresponding parts throughout the views, FIG. 1 depicts a cross-sectional view of the heat exchanger of the present invention, taken along section line 1-1 of FIG. 2, in which a tank or cistern 1 includes bottom end wall 2 and top end wall 3. The tank, which is normally closed, contains a pressurized heat exchange medium, for example water, with the pressure ensuring that circulation to distant points of use is achieved, as for example to radiators or the like. Located within the vessel is a heat exchanger battery 4 including a first (primary) portion or circuit provided with an inlet manifold pipe 5 and an outlet manifold pipe 6, and a second (secondary) portion or circuit provided with inlet and outlet manifold pipes 7 and 8, respectively. Carried within the primary and secondary circuits are primary and secondary heat exchange media, respectively. The primary and secondary circuits of the battery each comprise several layers of wound tubing 9, 10 which enclose and conduct respective heat exchange media from the inlet, to the outlet, manifold pipes, respectively.

The increased efficiency of the heat exchanger of the present invention is a direct consequence of the manner of winding the tubing used in the battery. The primary and secondary circuits, comprising the tubes 9, 10, respectively, are stacked alternately one on the other in a vertical extent in such a manner that every second tube in the vertical extent of the winding belongs to one circuit, and the other tube to the other circuit. The tubes 9 and 10 are pressed against each other in the stack, the end walls of the tank compressing the windings in an axial direction. Contact between the tubes, which preferably are metal, causes heat conduction from tube 9 to tube 10, the heat transport by contact with the surrounding radiator water effecting a double-exchange between the tubes 9 and 10. The coiled tubing 9 and 10 are in contact throughout their entire length from the inlet manifold pipe to the outlet manifold pipe, spirally disposed duct 13 being provided about the tubing within tank 1, to thereby enclose or jacket the entire stack of layered tubing 9, 10, 9, 10 . . .

The invention contemplates that the heat exchange medium used in the battery primary circuit will be freon, and the second circuit medium will be tap water. Thus, for example, radiator water coming from a pump is conducted into the tank through the bottom thereof by pipe 11. The water, heated by the tubing 9 which encloses the freon, is made to pass through the battery outwardly to the outlet pipe 12 located in the circumference of the tank shell. In addition, tap water is sent through the inlet manifold pipe 7, into the battery secondary circuit through the tubing 10, and out through the manifold pipe 8 to a point of use. The tap water carried by tubing 10 is heated by conduction, that is, the heat from tubing 9 being transferred to tubing 10. To enhance the heat transfer process, tubings 9 and 10 are arranged so that the freon in tubing 9 flows in a direction counter to the direction of flow of the water in tubing 10. The pressurized water conducted into tank 1 through pipe 11 is forced through ducting 13 between tubing 9 and 10, and passes through the ducting, adjacent to, and along the entire length of, the tubing 9 and 10. This, of course, assumes that inlet 11 and outlet 12 are located in the center, and periphery, of the tank 1, respectively.

Owing to the compression of the stacked winding, and the abutment of the end walls to the outermost layers, the necessity of a baffle between the turns is eliminated thereby enabling a tremendous savings. The compression of the stacked windings is further advantageous inasmuch as every turn of the winding presses against an adjacent turn, and the outermost layers press against the end walls so that the turns support each other and are thereby kept in place without any assisting means. The battery, and thus the heater exchanger, then attain a compact design which permits a simple installation of the exchanger.

From an economic standpoint, it is advantageous to heat each one of the primary and secondary circuits to a desired end temperature directly in the heat exchanger, inasmuch as losses will occur when the temperature first is increased in a circuit to a certain high value and after that decreased by mixing. Such an advantage is obtained by tapping the radiator water from duct 13 within the battery. The radiator water is therefore forced through spiral duct 13 in a direction counter to the direction of flow of the heat transfer medium in tube 9 so that the route of flow begins at the inlet 11 and proceeds in a spiralling fashion through duct 13 to a collecting duct 14, where the duct 13 ends, and the manifold pipe 15 conducts the water out of the vessel to a receiving consumer station. The collecting duct 14 intersects duct 13 and thus effectively shortens duct 13 in relation to the tubing 9, 10. Duct 13 extends a bit beyond collecting duct 14, but that portion does not take part in the flow. By shortening duct 13 in this way, an advantage may be obtained when it is desirable to control the heat imparted to the primary and secondary circuits, i.e. when there is a need to heat the tap water to a higher temperature than the radiator water. By using this first portion of the tertiary circuit (duct 13) only for heating the radiator water, it is possible to reach a higher temperature than when the primary and secondary circuits are employed all the way along the tertiary circuit. The tapping off through pipe 15 from collecting duct 14 brings radiator water having the proper end temperature directly in the exchanger, and mixing is therefore rarely required.

In a variation of the present invention, the circuit containing the radiator water includes an inlet 16 connected to an inlet duct 17, where a portion of duct 13 is circumvented. By such an arrangement, it is possible to provide an undercooling of the primary circuit, as, for example, when it comprises a condensor of a heat pump. In the end portion of the primary circuit, where the main part of the freon already has condensed but still contains an amount of heat, some heat exchange occurs between the freon and the tap water which, prior to the heat exchange, has a lower temperature. In the hottest portion of the primary circuit, the heat from the freon is transferred to the tap water with sufficiently high temperature to insure that the radiator water has a proper end temperature.

Obviously, many modifications and variations of the present invention are possible in light of the above teachings. For example, while the tap water in the above described embodiments may be the tertiary medium, and the radiator water the secondary medium, other media can also be utilized in the circuits. It is therefore understood that, within the scope of the appended claims, the invention may be practiced otherwise specifically described herein.

We claim:

1. A tertiary heat exchanger, comprising:

a container including inlet and outlet means;

a first fluid conducted into said container through one of said inlet means;

first conducting means spirally disposed within said container, and forming a passageway extending from said one inlet means outward to one outlet means, for conducting said first fluid out of said container;

second conducting means for conducting a second fluid through said container;

third conducting means for conducting a third fluid through said container;

at least one of said conducting means having a length which is different from the other conducting means;

one of said fluids being heated, and a substantial portion of said second and third conducting means is coiled within said first conducting means so that each of said second and third conducting means comprises a layered stack wherein each turn of the respective coil defines one layer, and heat from the heated fluid is imparted to the remaining fluids by conduction when said fluids are caused to flow through their respective conducting means;

the direction of flow of fluid in said second conducting means is opposite to the direction of flow of fluid in said third conducting means; and said container further comprises surface means located above and below said second and third conducting means for pressing said second conducting means against said third conducting means throughout their entire lengths to facilitate maximum heat transfer between said conducting means.

2. The tertiary heat exchanger as claimed in claim 1 wherein said second and third coiled conducting means form a single stack having a plurality of layers, wherein every $n^{th}$ layer comprises said second conducting means, and every $n+1^{th}$ layer comprises said third conducting means.

3. The tertiary heat exchanger as defined in claim 1 wherein the layered stack formed by said second conducting means comprises, with the layered stack formed by said third conducting means, a single layered stack wherein successive layers of said first stack alternate with successive layers of said second stack.

4. The tertiary heat exchanger as defined in claim 1 wherein said single layered stack defines, in vertical cross-section, a plurality of vertically extending rows, each said row compressed between said surfaces means, and said first conducting means defines, in vertical cross-section, a plurality of compartments, each compartment being configured to jacket a single row.

5. The tertiary heat exchanger as defined in claim 4 wherein at least one of said fluids is liquid and is conducted through said container under pressure, and at least one of said fluids in said second and third means is heated.

6. The tertiary heat exchanger as defined in claim 2 wherein said single layered stack defines, in vertical cross-section, a plurality of vertically extending rows, each said row compressed between said surfaces means, and said first conducting means defines, in vertical cross-section, a plurality of compartments, each compartment being configured to jacket a single row.

7. The tertiary heat exchanger as defined in claim 6 wherein at least one of said fluids is liquid and is conducted through said container under pressure, and at least one of said fluids in said second and third means is heated.

8. The tertiary heat exchanger as defined in claim 3 wherein said single layered stack defines, in vertical cross-section, a plurality of vertically extending rows, each said row compressed between said surfaces means, and said first conducting means defines, in vertical cross-section, a plurality of compartments, each compartment being configured to jacket a single row.

9. The tertiary heat exchanger as defined in claim 8 wherein at least one of said fluids is liquid and is conducted through said container under pressure, and at least one of said second and third fluids is heated.

10. The tertiary heat exchanger of claim 1 wherein said container outlet means comprises two outlets associated with said first conducting means including means for selectively rerouting said first fluid through one of said two outlets so that said first fluid can be conducted out of said container through only one of said two outlets.

11. The tertiary heat exchanger of claim 10 wherein;

one of said two outlets is located in a side wall of said container, and said one of said container inlet means is located at the center of one of said surface means, so that the distance over which said first fluid is conducted is maximized.

12. The tertiary heat exchanger of claim 11 wherein the other of said two outlets is disposed in the surface means at a first location between said one of said inlet means and said one of said two outlets, and said rerouting means comprises means for intersecting said first conducting means along the length thereof at said first location, so that when said rerouting means becomes operative, said other of said two outlets are opened causing said first fluid to flow out of said container through said other outlet and thereby altering, by shortening, the effective length of said first conducting means.

13. The tertiary heat exchanger of claim 1 wherein said container includes inlet means for each of said second and said third conducting means, one of said second and third conducting means comprising two outlets, and further comprising means, associated with said outlets, for alternately rerouting the fluid in said one of said conducting means through an appropriate one of said outlets so that only one outlet at a time is operative, and the distance between the inlet means of said one of said second and third conducting means and one of said appropriate outlets being greater than the distance between the other inlet means and said other of said appropriate outlets, so that alternate rerouting of said fluid in said one of said second and third conducting means to said appropriate one of said outlets causes heat transfer to occur for differing periods of time between the respective said one fluid and the remaining fluids.

* * * * *